US005433425A

United States Patent [19]

Kubota et al.

[11] Patent Number: 5,433,425

[45] Date of Patent: Jul. 18, 1995

[54] PAPER FEEDING DEVICE AND PAPER CURLING CORRECTING DEVICE

[75] Inventors: Hiroshi Kubota, Osaka; Kenji Oda, Toyonaka; Masami Fuchi, Neyagawa, all of Japan

[73] Assignee: Mita Industrial Co., Ltd., Japan

[21] Appl. No.: 165,351

[22] Filed: Dec. 13, 1993

Related U.S. Application Data

[62] Division of Ser. No. 943,471, Sep. 11, 1992, Pat. No. 5,292,115.

[51] Int. Cl.[6] ..... B65H 3/44

[52] U.S. Cl. ..... 271/9.12

[58] Field of Search ..... 271/122, 9, 114, 116

[56] References Cited

U.S. PATENT DOCUMENTS

| | | | |
|---|---|---|---|
| 3,961,786 | 6/1976 | Yanker | 271/122 |
| 4,674,736 | 6/1987 | Tsubo | 271/122 |
| 4,855,794 | 8/1989 | Suzuki | 271/9 X |
| 5,029,840 | 7/1991 | Haga | 271/122 |
| 5,039,080 | 8/1991 | Kato | 271/122 |
| 5,050,854 | 9/1991 | Tajima | 271/122 |
| 5,069,434 | 12/1991 | Sellers | 271/9 X |
| 5,085,420 | 2/1992 | Sata | 271/122 X |
| 5,158,279 | 10/1992 | Laffey | 271/122 X |
| 5,199,695 | 4/1993 | Nakahata et al. | 271/9 |
| 5,232,211 | 8/1993 | Kubota | 271/122 X |
| 5,253,856 | 10/1993 | Fuchi et al. | 271/9 |

*Primary Examiner*—David H. Bollinger
*Attorney, Agent, or Firm*—Beveridge, DeGrandi, Weilacher & Young

[57] ABSTRACT

In a time period from the time point where the forward end of a paper sheet fed from a pair of paper separation rollers reaches a registration roller to the time point where the registration roller is driven, when the load torque exerted on a forward roller is not less than second regulated torque, the transmission of power to the forward roller is released by a torque limiter provided for the forward roller. In this case, therefore, the force of paper feeding produced by the pair of paper separation rollers is regulated. Consequently, a suitable force of paper feeding can be applied to the paper sheet, thereby to make it possible to regulate the paper sheet straight in the direction of paper feeding as well as to prevent the paper sheet from continuing to be fed even if the amount of deflection of the paper sheet is saturated between the pair of paper separation rollers and the registration roller to prevent the paper sheet from being wrinkled.

6 Claims, 11 Drawing Sheets

PAPER FEEDING DEVICE AND PAPER CURLING CORRECTING DEVICE

This is a divisional of application Ser. No. 07/943,471, filed on Sep. 11, 1992, now U.S. Pat. No. 5,292,115.

BACKGROUND OF THE INVENTION

1. Field of the Invention

The present invention relates to a paper feeding device and a paper curling correcting device in an image forming apparatus such as a copying machine, a PPF, a page printer or the like.

2. Description of the Prior Art

In an image forming apparatus such as a copying machine, a PPF, a page printer or the like, a pair of paper separation rollers for preventing paper sheets from being fed in an overlapped state to feed a single paper sheet to a registration roller provided in a paper conveying path from a paper feeding cassette.

The pair of paper separation rollers comprises one forward roller and one reverse roller, as is well known. The forward roller is rotated and driven in the direction in which paper sheets are fed from the paper feeding cassette to the registration roller (hereinafter referred to as the direction of paper feeding). The reverse roller is rotated and driven in the direction in which paper sheets are returned from the registration roller to the paper feeding cassette (hereinafter referred to as the direction of paper return). The reverse roller is provided with a torque limiter for releasing the transmission of power from a driving source to the reverse roller when the load torque exerted on the reverse roller is not less than a predetermined regulated torque.

When a plurality of paper sheets are fed in an overlapped state to the pair of paper separation rollers, the load torque exerted on the reverse roller is lower than the regulated torque, so that the reverse roller is rotated and driven in the direction of paper return. Accordingly, the paper sheets on the reverse roller side are returned by the reverse roller, while a single paper sheet is fed to the registration roller by the forward roller.

When one paper sheet is fed to the area between the pair of paper separation rollers, the load torque exerted on the reverse roller is higher than the regulated torque, so that the transmission of power from the driving source to the reverse roller is released. Accordingly, the reverse roller is rotated in the direction of paper feeding in synchronism with the forward roller. Consequently, the paper sheet is fed to the registration roller.

In this type of image forming apparatus, the registration roller is driven in a state where a paper sheet is deflected between the registration roller and the pair of paper separation rollers so as to regulate the paper sheet straight in the direction of paper feeding and feed the same to a photosensitive drum. That is, the registration roller is driven after a delay of several milliseconds from the time when the forward end of the paper sheet passing between the pair of paper separation rollers abuts on the registration roller.

In the above described conventional device, the force of paper feeding produced by the pair of paper separation rollers depends on only the friction force between the paper sheet and the forward roller, so that the amount of deflection varies depending on the quality and the thickness of the paper sheet. Accordingly, the paper sheet may, in some cases, continue to be fed even if the amount of deflection of the paper sheet is saturated, so that the paper sheet is wrinkled.

Furthermore, examples of image forming apparatuses include an image forming apparatus in which a paper conveying path from a paper feeding cassette to a registration roller is formed in a U shape for the purpose of, for example, miniaturization. In such an image forming apparatus, however, paper sheets are curled to correspond to the curve of the paper conveying path in a U shape.

Further, examples of image forming apparatuses include an image forming apparatus for feeding parallel paper sheets such as envelopes contained in two rows in a paper feeding cassette by a paper feeding roller and conveying two paper sheets fed in parallel to a registration roller by passing through a pair of paper separation rollers or directly without passing through the pair of paper separation rollers. In such a image forming apparatus, the paper sheets contained in two rows in the paper feeding cassette may, in some cases, start to be fed in a state where the paper sheet contained in one of the rows in the paper feeding cassette is projected forward in the direction of paper feeding from the paper feeding cassette due to the feeding of the paper sheets in the row continuously or one over the other. Consequently, the paper sheet in the row projected forward in the direction of paper feeding from the paper feeding cassette abuts the registration roller prior to the paper sheet in the other row. In such a case, the pair of paper separation rollers or the paper feeding roller for conveying paper sheets to the registration roller continues to feed the paper sheets in a time period elapsed from the time when the paper sheet in the row projected forward in the direction of paper feeding from the paper feeding cassette abuts the registration roller until the paper sheet in the other row abuts the registration roller. Accordingly, the deflection of the paper sheet in the row which first abuts on the registration roller becomes large, so that the paper sheet is wrinkled or folded causing vibration and noise.

A first object of the present invention is to provide a paper feeding device capable of regulating a paper sheet straight in the direction of paper feeding as well as preventing the paper sheet from being wrinkled with respect to a plurality of types of paper sheets.

A second object of the present invention is to provide a paper curling correcting device for preventing a paper sheet from being curled in an image forming apparatus having a paper conveying path in a U shape.

A third object of the present invention is to provide a paper feeding device capable of preventing, when paper sheets are fed in parallel, one of the paper sheets which first abuts on a registration roller from being wrinkled.

SUMMARY OF THE INVENTION

A first paper feeding device according to the present invention is characterized in that a pair of paper separation rollers comprising a forward roller which is rotated and driven in the direction of paper feeding and a reverse roller which is rotated and driven in the direction of paper return is provided upstream of a registration roller. The above described reverse roller is provided with a first torque limiter for releasing the transmission of power from a driving source to the reverse roller when the load torque exerted on the reverse roller is not less than the first regulated torque. The above described forward roller is also provided with a second torque limiter for releasing the transmission of power from the driving source to the forward roller when the load torque exerted on the forward roller is not less than the second regulated torque which is higher than the first regulated torque.

The above described registration roller is rotated and driven after a predetermined time delay which starts after the leading edge of a paper sheet passing through the above described pair of paper separation rollers reaches abuts the registration roller.

When the load torque exerted on the forward roller is not less than the second regulated torque in a time period elapsed from the time point where the forward end of the paper sheet fed from the pair of paper separation rollers reaches the registration roller until the registration roller is driven, the transmission of power to the forward roller is released by the torque limiter provided for the forward roller. In this case, the force of paper feeding produced by the pair of paper separation rollers is regulated. Consequently, a suitable force of paper feeding can be applied to the paper sheet, making it possible to regulate the paper sheet straight in the direction of paper feeding as well as to prevent the paper sheet from continuing to be fed even if the amount of deflection of the paper sheet is saturated between the pair of paper separation rollers and the registration roller to prevent the paper sheet from being wrinkled.

In a paper curling correcting device in an image forming apparatus in which a paper conveying path from a paper stock section to a registration roller is curved in a U shape, a pair of paper separation rollers is provided halfway in the above described paper conveying path, the above described pair of paper separation rollers comprises a forward roller which is rotated and driven in the direction of paper feeding from the paper stock section to the registration roller and a reverse roller which is rotated and driven in the direction of paper return from the registration roller to the paper stock section, and the above described forward roller is arranged inside of the curve of the paper conveying path and the above described reverse roller is arranged outside of the curve of the paper conveying path, a first paper curling correcting device according to the present invention is characterized in that a curling correcting roller which is in contact with the above described forward roller and is rotated and driven in the direction of paper return from the above described registration roller to the above described paper stock section is provided on the side of the above described registration roller from the above described reverse roller, the above described reverser roller is provided with a third torque limiter for releasing the transmission of power from a driving source to the reverse roller when the load torque exerted on the reverse roller is not less than predetermined third regulated torque, the above described curling correcting roller is provided with a fourth torque limiter for releasing the transmission of power from the driving source to the curling correcting roller when the load torque exerted on the curling correcting roller is not less than predetermined fourth regulated torque, and the force of paper return produced by the above described curling correcting roller in a case where the above described fourth regulated torque is taken as the driving torque applied to the curling correcting roller is smaller than the force of paper feeding produced by the forward roller.

In the first paper curling correcting device according to the present invention, when a paper sheet fed to the area between the forward roller and the curling correcting roller is fed toward the registration roller, the force of paper feeding produced by the forward roller and the force of paper return produced by the curling correcting roller are exerted on the paper sheet. That is, the paper sheet is fed in the direction of paper feeding by a force of paper feeding corresponding to the difference between the force of paper feeding produced by the forward roller and the force of paper return produced by the curling correcting roller. The force of paper feeding corresponding to the difference between the force of paper feeding produced by the forward roller and the force of paper return produced by the curling correcting roller becomes a value corresponding to the difference between the force of paper feeding produced by the driving torque applied to the forward roller and the force of paper return produced by the curling correcting roller in a case where the fourth regulated torque is taken as the driving torque applied to the curling correcting roller.

When the paper sheet passes between the forward roller and the curling correcting roller toward the registration roller, the force of paper feeding produced by the forward roller and the force of paper return produced by the curling correcting roller are exerted on the paper sheet, so that the resisting force in the direction of paper return is exerted on the surface on the side of the curling correcting roller out of both surfaces of the paper sheet. This resisting force is exerted on the paper sheet as a force to curve the paper sheet in the opposite direction to the curve of the paper conveying path in a U shape. Consequently, the curling of the paper sheet corresponding to the curve of the paper conveying path in a U shape is removed.

In a paper curling correcting device in an image forming apparatus in which a paper conveying path from a paper stock section to a registration roller is curved in a U shape, a pair of paper separation rollers is provided halfway in the above described paper conveying path, the above described pair of paper separation rollers comprises a forward roller which is rotated and driven in the direction of paper feeding from the paper stock section to the registration roller and a reverse roller which is rotated and driven in the direction of paper return from the registration roller to the paper stock section, and the above described forward roller is arranged inside of the curve of the paper conveying path and the above described reverse roller is arranged outside of the curve of the paper conveying path, a second paper curling correcting device according to the present invention is characterized in that a curling correcting roller which is in contact with the above described forward roller is rotatably provided on the side of the above described registration roller from the above described reverse roller.

In the second paper curling correcting device according to the present invention, when a paper sheet passes between the forward roller and the curling correcting roller toward the registration roller, the resisting force in the direction of paper return is exerted on the surface on the side of the curling correcting roller out of both surfaces of the paper sheet by the own weight of the curling correcting roller. This resisting force is exerted on the paper sheet as a force to curve the paper sheet in the opposite direction to the curve of the paper conveying path in a U shape. Consequently, the curling of the paper sheet corresponding to the curve of the paper conveying path in a U shape is removed.

In a paper feeding device comprising a paper feeding roller for feeding in parallel paper sheets contained in parallel in a paper stock section and a delivery roller for delivering a plurality of paper sheets fed by the above described paper feeding roller to a registration roller, a second paper feeding device according to the present invention is characterized in that the above described delivery roller comprises a plurality of roller portions coaxially provided side by side, and each of the above described roller portions comprises a torque limiter mechanism which is idled if load torque of not less than predetermined torque is applied thereto.

In the second paper feeding device according to the present invention, the plurality of paper sheets fed by the paper feeding roller are fed in parallel by the respective roller portions in the delivery roller. The paper sheet which first abuts on the registration roller out of the above described paper sheets fed in parallel is deflected until the other paper sheet reaches the registration roller. If load torque of not less than predetermined torque is applied to the roller portion corresponding to the paper sheet by the deflection, the roller portion is idled. Consequently, the paper sheet is not further deflected, to be held in a proper nip state.

In a paper feeding device comprising a paper feeding roller for feeding in parallel paper sheets contained in parallel in a paper feeding cassette to a registration roller, a third paper feeding device according to the present invention is characterized in that the above described paper feeding roller comprises a plurality of roller portions coaxially provided side by side, and each of the roller portions comprises a torque limiter mechanism which is idled if load torque of not less than predetermined torque is applied thereto.

In the third paper feeding device according to the present invention, the plurality of paper sheets in the paper feeding cassette are fed in parallel by the respective roller portions in the paper feeding roller to the registration roller. The paper:sheet which first abuts on the registration roller out of the paper sheets fed in parallel is deflected until the other paper sheet reaches the registration roller. If load torque of not less than predetermined torque is applied to the roller portion corresponding to the paper sheet which first abuts on the registration roller by the deflection, the roller portion is idled. Consequently, the paper sheet is not further deflected, to be held in a proper nip state.

The foregoing and other objects, features, and aspects and advantages of the present invention will become more apparent from the following detailed description of the present invention when taken in conjunction with the accompanying drawings.

DESCRIPTION OF THE PREFERRED EMBODIMENTS

Description is now made of embodiments of the present invention with reference to the drawings.

Figure 1:
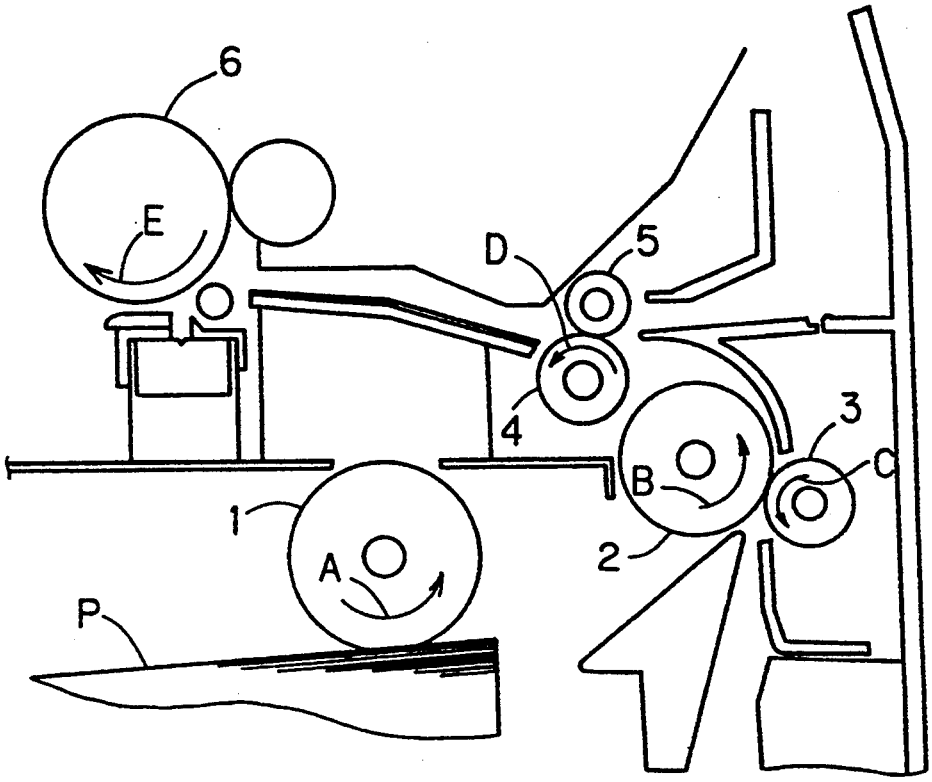
FIG. 1 is a diagram illustrating the construction of a paper feeding mechanism of a printer according to a first embodiment of the present invention.

Referring now to FIG. 1, description is made of a first embodiment of the present invention.

FIG. 1 illustrates a paper feeding mechanism of a printer. Paper sheets P stocked in a paper stock section are fed by a paper feeding roller 1 to a pair of paper separation rollers 2 and 3. The paper sheets are fed to a pair of registration rollers 4 and 5 by the pair of paper separation rollers 2 and 3. The paper sheets are fed to a photosensitive drum 6 by the pair of registration rollers 4 and 5.

The pair of paper separation rollers 2 and 3 comprises a forward roller 2 and a reverse roller 3. The forward roller 2 is rotated and driven in the direction in which paper sheets P are fed from the paper stock section to the pair of registration rollers 4 and 5 (hereinafter referred to as the direction of paper feeding) by a driving source (not shown). The direction in which the forward roller 2 is driven and rotated is indicated by an arrow B. The reverse roller 3 is rotated and driven in the direction in which paper sheets P are returned from the pair of registration rollers 4 and 5 to the paper stock section (hereinafter referred to as the direction of paper return) by the driving source (not shown). The direction in which the reverse roller 3 is driven and rotated is indicated by an arrow C.

The reverse roller 3 is provided with a first torque limiter (not shown) for releasing the transmission of power from the driving source to the reverse roller 3 when the load torque in the direction of paper feeding which is exerted on the reverse roller 3 is not less than predetermined first regulated torque. A powder type torque limiter, for example, is used as the first torque limiter. The first regulated torque is lower than the load torque exerted on the reverse roller 3 in a case where one paper sheet P is fed to the area between the forward roller 2 and the reverse roller 3 and is higher than the load torque exerted on the reverse roller 4 in a case where two paper sheets P are fed to the area between the forward roller 2 and the reverse roller 3.

The forward roller 2 is provided with a second torque limiter (not shown) for releasing the transmission of power from the driving source to the forward roller 2 when the load torque in the direction of paper feeding which is exerted on the forward roller 2 is not less than predetermined second regulated torque which is higher than the first regulated torque. Used as the second torque limiter is a torque limiter in which a forward roller 2 is rotatably supported on its axis of rotation and connected to a limiter boss fixed to the axis of rotation through a spring coil, and the spring coil is opened to release the connection between the forward roller 2 and the limiter boss when the load torque exerted on the forward roller 2 is not less than the second regulated torque. The second regulated torque is set to a value satisfying the following equation (1) if T1 is taken as first regulated torque. T2 is taken as second regulated torque, D1 is taken as the outer diameter of the reverse roller 3, D2 is taken as the outer diameter of the forward roller 2, and Fp is taken as the nerve of a paper sheet P.

$$(T2/D2)-(T1/D1)<Fp \quad (1)$$

The paper feeding roller 1 is rotated and driven in the direction indicated, by an arrow A to feed the paper sheets P stocked in the paper stock section. When one paper sheet P is fed to the area between the pair of paper separation rollers 2 and 3, the load torque exerted on the reverse roller 3 is higher than the first regulated torque, so that the transmission of power from the driving source to the reverse roller 3 is released by the function of the first torque limiter. Consequently, the reverse roller 3 is rotated and driven in the direction of paper feeding in synchronism with the forward roller 2, so that the one paper sheet P fed to the area between the pair of paper separation rollers 2 and 3 is fed to the pair of registration rollers 4 and 5.

The paper feeding roller 1 is rotated and driven in the direction indicated by the arrow A to feed the paper sheets P stocked in the paper stock section. When a plurality of paper sheets P are fed in an overlapped state to the pair of paper separation rollers 2 and 3, the load torque exerted on the reverse roller 3 is lower than the first regulated torque, so that the reverse roller 3 is rotated and driven in the direction of paper return. Accordingly, the paper sheets P on the side of the reverse roller 3 are returned by the reverse roller 3, and only the one paper sheet P on the side of the forward roller 2 is fed to the pair of registration rollers 4 and 5 by the forward roller 2.

The registration roller 4 is driven after a delay of a predetermined time period from the time point where the forward end of the paper sheet P fed from the pair of paper separation rollers 2 and 3 abuts on the pair of registration rollers 4 and 5. When the forward end of the paper sheet P fed from the pair of the paper separation rollers 2 and 3 abuts on the pair of registration rollers 4 and 5, the load torque exerted on the reverse roller 3 is lower than the first regulated torque, so that the reverse roller 3 is rotated and driven in the direction of paper return. On the other hand, the forward roller 2 is rotated and driven in the direction of paper feeding, so that a force of paper feeding corresponding to the difference between the force of paper feeding produced by the forward roller 2 and the force of paper return produced by the reverse roller 3 is applied to the paper sheet P.

In a time period from the time point where the forward end of the paper sheet P fed from the pair of paper separation rollers 2 and 3 abuts on the pair of registration rollers 4 and 5 to the time point where the registration roller 4 is driven, if the load torque exerted on the forward roller 2 is not less than the second regulated torque, the connection between the forward roller 2 and its driving shaft is released by the second torque limiter provided for the forward roller 2.

Consequently, the force of paper feeding $F_M$ produced by the pair of paper separation rollers 2 and 3 in a time period from the time point where the forward end of the paper sheet P fed from the pair of paper separation rollers 2 and 3 reaches the pair of registration rollers 4 and 5 to the time point where the registration roller 4 is driven is regulated as represented by the following equation (2):

$$F_M=(T2/D2)-(T1/D1) \quad (2)$$

As can be seen from the above described equation (2), the force $F_M$ of paper feeding is the same as the left side of the above described equation (1). By setting the second regulated torque T2 to, for example, a value satisfying the above described equation (1) with respect to a plurality of types of paper sheets which differ in thickness, a suitable force of paper feeding $F_M$ can be applied to the paper sheet P fed from the pair of paper separation rollers 2 and 3 in a time period from the time point where the forward end of the paper sheet P abuts on the pair of registration rollers 4 and 5 to the time point where the registration roller 4 is driven with respect to the plurality of types of paper sheets which differ in thickness. Therefore, it is possible to regulate the paper sheet P straight in the direction of paper feeding as well as to prevent the paper sheet P from continuing to be fed even if the amount of deflection of the paper sheet P is saturated between the pair of paper separation rollers 2 and 3 and the pair of registration rollers 4 and 5 to prevent the paper sheet P from being wrinkled.

When the registration roller 4 is rotated and driven in the direction indicated by an arrow D after the forward end of the paper sheet P fed from the pair of paper separation rollers 2 and 3 reaches the pair of registration rollers 4 and 5, the paper sheet P is fed to the photosensitive drum 6 by the pair of registration rollers 4 and 5. The direction of rotation of the photosensitive drum 6 is indicated by an arrow E.

Consider a case where the outer diameter D2 of the forward roller 2 is 28 mm, the outer diameter D1 of the reverse roller 3 is 18 mm. the nip width is 40 mm. and the first regulated torque T1 is 300 gfcm. In this case, the second regulated torque T2 is changed to 600 gfcm, 800 gfcm. and 1000 gfcm to conduct experiments with respect to a thin paper sheet having a thickness of 60 $g/m^2$ and a thick paper sheet having a thickness of 90 $g/cm^2$As a result even when the second regulated torque T2 is set to any one of 600 gfcm, 800 gfcm, and 1000 gfcm, the thin paper sheet having a thickness of 60 $g/m^2$ and the thick paper sheet having a thickness of 90 $g/m^2$ can be regulated straight in the direction of paper feeding and fed to the photosensitive drum 6. Moreover, the paper sheets are not wrinkled.

Figure 2:
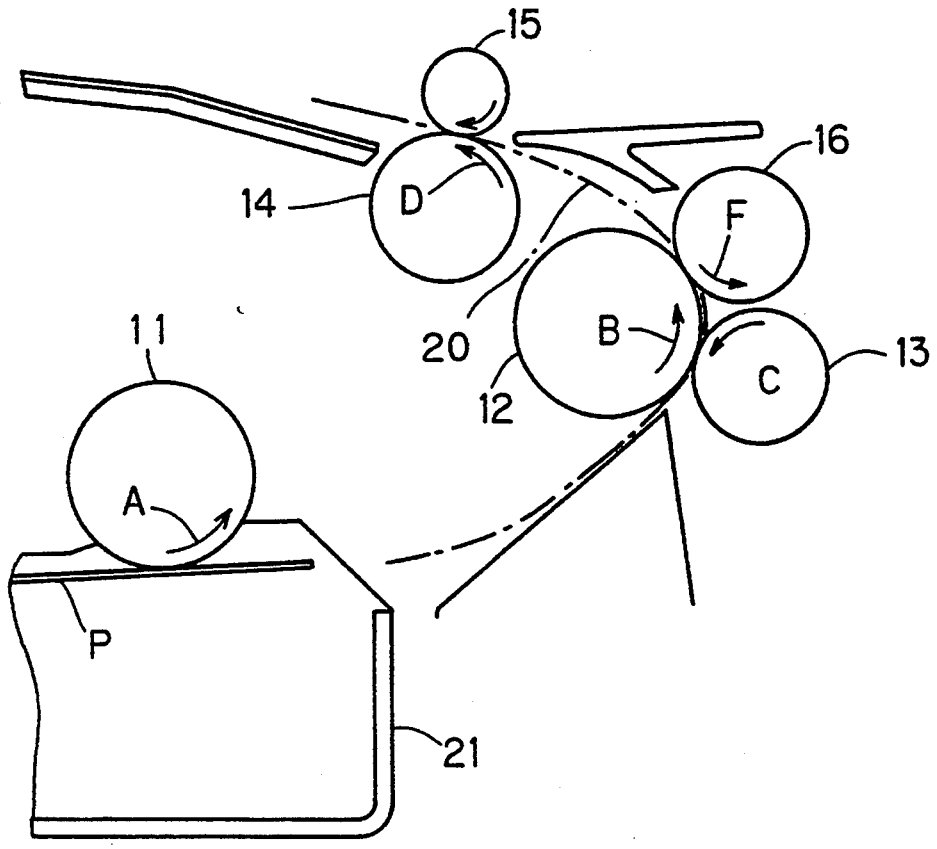
FIG. 2 is a diagram illustrating the construction of a paper feeding mechanism of a printer according to a second embodiment of the present invention.
Figure 3:
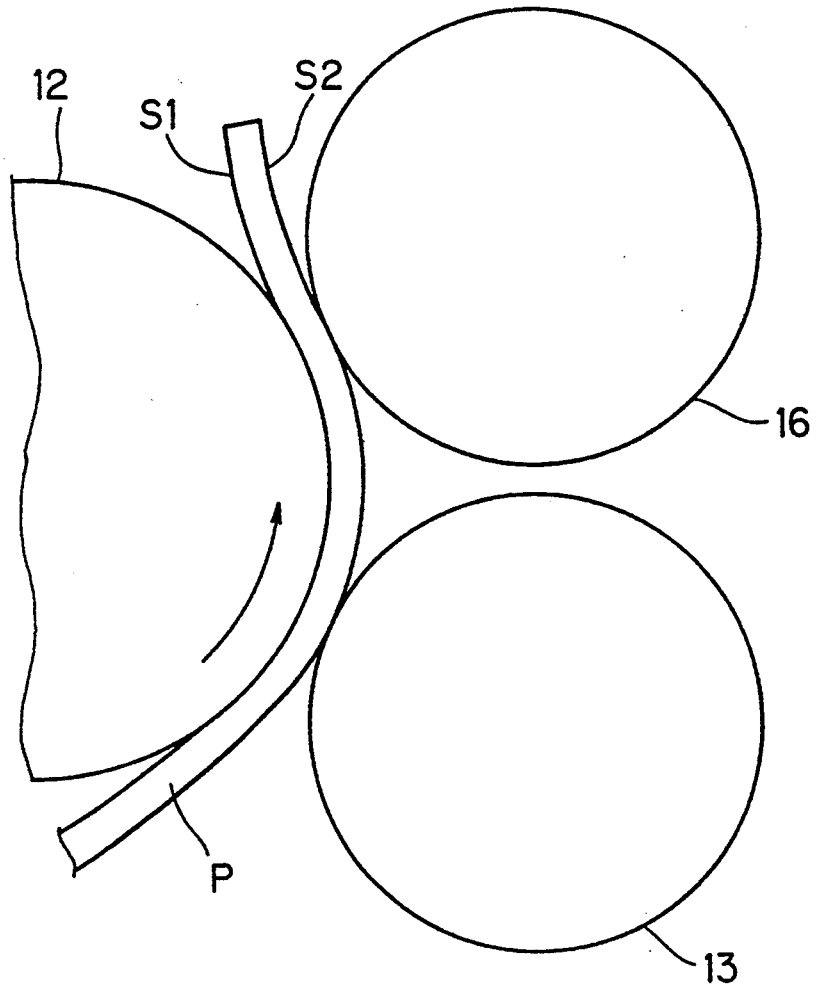
FIG. 3 is a partially enlarged view illustrating a state where the curling of a paper sheet is corrected.

Referring now to FIGS. 2 and 3, description is made of a second embodiment of the present invention.

FIG. 2 illustrates a paper feeding mechanism of a copying machine.

In this copying machine, a paper conveying path 20 from a paper feeding cassette 21 to a pair of registration rollers 14 and 15 is formed in a U shape as viewed from the side. Paper sheets P are stocked with they being overlapped with each other in the paper feeding cassette 21, and the paper sheets P in the paper feeding cassette 21 are fed by a paper feeding roller 11. A pair of paper separation rollers 12 and 13 for preventing the paper sheets P from being fed with their being overlapped with each other to feed the paper sheets P one at a time is provided halfway in the paper conveying path 20 in a U shape.

The pair of paper feeding rollers 12 and 13 comprises a forward roller 12 and a reverse roller 13 which is in contact with the forward roller 12. The forward roller 12 is arranged inside of the curve of the paper conveying path 20 in a U shape, and the reverse roller 13 is arranged outside of the curve of the paper conveying path 20. The forward roller 12 is rotated and driven in the direction in which paper sheets P are fed from the paper feeding cassette 21 to the pair of registration rollers 14 and 15 (hereinafter referred to as the direction of paper feeding) by a driving source (not shown). The direction in which the forward roller 12 is driven and rotated is indicated by an arrow B. The reverse roller 13 is rotated and driven in the direction in which paper sheets P are returned from the pair of registration rollers 14 and 15 to the paper feeding cassette 21 (hereinafter referred to as the direction of paper return) by the driving source (not shown). The direction in which the reverse roller 13 is driven and rotated is indicated by an arrow C.

The reverse roller 13 is provided with a third torque limiter (not shown) for releasing the transmission of power from the driving source to the reverse roller 13 when the load torque in the direction of paper feeding which is exerted on the reverse roller 13 is not less than predetermined third regulated torque. A powder type torque limiter, for example, is used as the third torque limiter. The third regulated torque is set to a value between the load torque exerted on the reverse roller 13 in a case where one paper sheet is fed to the area between the forward roller 12 and the reverse roller 13 and the load torque exerted on the reverse roller 13 in a case where two paper sheets are fed to the area between the forward roller 12 and the reverse roller 13.

A curling correcting roller 16 which is in contact with the forward roller 12 is arranged on the upstream side in the direction of paper feeding of the reverse roller 13. This curling correcting roller 16 is rotated and driven in the direction of paper return by the driving source (not shown), similarly to the reverse roller 13. The direction in which the curling correcting roller 16 is driven and rotated is indicated by an arrow F.

The curling correcting roller 16 is provided with fourth torque limiter (not shown) for releasing the transmission of power from the driving source to the curling correcting roller 16 when the load torque in the direction of paper feeding which is exerted on the curling correcting roller 16 is not less than predetermined fourth regulated torque. A powder type torque limiter, for example, is used as the fourth torque limiter. The fourth regulated torque is not less than the load torque exerted on the curling correcting roller 16 in a case where one paper sheet is fed to the area between the forward roller 12 and the curling correcting roller 16, and the force of paper return produced by the curling correcting roller 16 in a case where the fourth regulated torque is taken as the driving torque applied to the curling correcting roller 16 is set to a value smaller than the force of paper feeding produced by the forward roller 12. That is, the fourth regulated torque is higher than the third regulated torque.

The paper feeding roller 11 is rotated and driven in the direction indicated by an arrow A to feed the paper sheets P from the paper feeding cassette 21. When one paper sheet P is fed to the area between the forward roller 12 and the reverse roller 13, the load torque exerted on the reverse roller 13 is higher than the third regulated torque, so that the transmission of power from the driving source to the reverse roller 13 is released. Consequently, the reverse roller 13 is rotated and driven in the direction of paper feeding in synchronism with the forward roller 12, so that the one paper sheet P fed to the area between the pair of paper separation rollers 12 and 13 is fed to the area between the forward roller 12 and the curling correcting roller 16.

The paper sheets P are fed from the paper feeding cassette 21 by the paper feeding roller 11. When two paper sheets P are fed with they being overlapped with each other to the area between the forward roller 12 and the reverse roller 13, the load torque exerted on the reverse roller 13 is lower than that in the case where one paper sheet P is fed and is lower than the third regulated torque. Consequently, the reverse roller 13 is rotated and driven in the direction of paper return. Accordingly, the paper sheet P on the side of the reverse roller 13 is returned by the function of the reverse roller 13, and only the paper sheet P on the side of the forward roller 12 is fed to the area between the forward roller 12 and the curling correcting roller 16.

Even when two paper sheets P are fed with their being overlapped with each other to the area between the forward roller 12 and the reverse roller 13 the load torque exerted on the reverse roller 13 may, in some cases, be higher than the third regulated torque depending on, for example, the type of paper sheets P. In such a case, the transmission of power from the driving source to the reverse roller 13 is released. Accordingly, the reverse roller 13 is rotated in the direction of paper feeding in synchronism with the forward roller 12, so that the two paper sheets P are fed to the area between the forward roller 12 and the curling correcting roller 16. However, the fourth regulated torque is higher than the third regulated torque. Accordingly, the load torque transmitted to the curling correcting roller 16 is liable to be lower than the fourth regulated torque, so that the curling correcting roller 16 is rotated and driven in the direction of paper return. Even if two paper sheets P are fed with their being overlapped with each other to the area between the forward roller 12 and the curling correcting roller 16, therefore, the paper sheet P on the side of the curling correcting roller 16 is returned by the function of the curling correcting roller 16, and only the paper sheet P on the side of thee forward roller 12 is fed toward the pair of registration rollers 14 and 15.

When the paper sheet P fed to the area between the forward roller 12 and the curling correcting roller 16 is fed toward the pair of registration rollers 14 and 15, the force of paper feeding produced by the forward roller 12 and the force of paper return produced by the curling correcting roller 16 are exerted on the paper sheet P. That is, the paper sheet P is fed in the direction of paper feeding by a force of paper feeding corresponding to the difference between the force of paper feeding produced by the forward roller 12 and the force of paper return produced by the curling correcting roller 16. The force of paper feeding corresponding to the difference between the force of paper feeding produced by the forward roller 12 and the force of paper return produced by the curling correcting roller 16 is a value corresponding to the difference between the force of paper feeding produced by the driving torque applied to the forward roller 12 and the force of paper return produced by the curling correcting roller 16 in a case where the fourth regulated torque is taken as the driving torque applied to the curling correcting roller 16.

When the paper sheet P passes between the forward roller 12 and the curling correcting roller 16 toward the pair of registration rollers 14 and 15, the force of paper feeding produced by the forward roller 12 and the force of paper return produced by the curling correcting roller 16 are exerted on the paper sheet P. Accordingly, as shown in FIG. 3, the resisting force in the direction of paper return is exerted on a surface S2 on the side of the curling correcting roller 16 out of both surfaces S1 and S2 of the paper sheet P. This resisting force is exerted on the paper sheet P as a force to curve the paper sheet P in the opposite direction to the curve of the paper conveying path 20 in a U shape. Consequently, the curling of the paper sheet P corresponding to the curve of the paper conveying path 20 in a U shape is removed. so that the paper sheet P which is not curled is fed to the pair of registration rollers 14 and 15. The registration roller 14 is rotated and driven in the direction indicated by an arrow D. so that the paper sheet P is fed toward the photosensitive drum.

Although in the above described embodiment. the curling correcting roller 16 is rotated, and driven in the direction of paper return by the driving source (not shown), similarly to the reverse roller 13, and the curling correcting roller 16 is provided with the fourth torque limiter, an idling roller rotatably supported may be used as the curling correcting roller 16. In this case, when the paper sheet P passes between the forward roller 12 and the curling correcting roller 16 toward the pair of registration rollers 14 and 15, the resisting force in the direction of paper return is exerted on the surface S2 on the side of the curling correcting roller 16 out of both the surfaces S1 and S2 of the paper sheet P. This resisting force is exerted on the paper sheet P as a force to curve the paper sheet P in the opposite direction to the curve of the paper conveying path 20 in a U shape. Consequently, the curling of the paper sheet P corresponding to the curve of the paper conveying path 20 in a U shape is removed, so that the paper sheet P which is not curled is fed to the pair of registration rollers 14 and 15.

Referring now to FIGS. 4 to 7, description is made of a third embodiment of the present invention.

Figure 5:
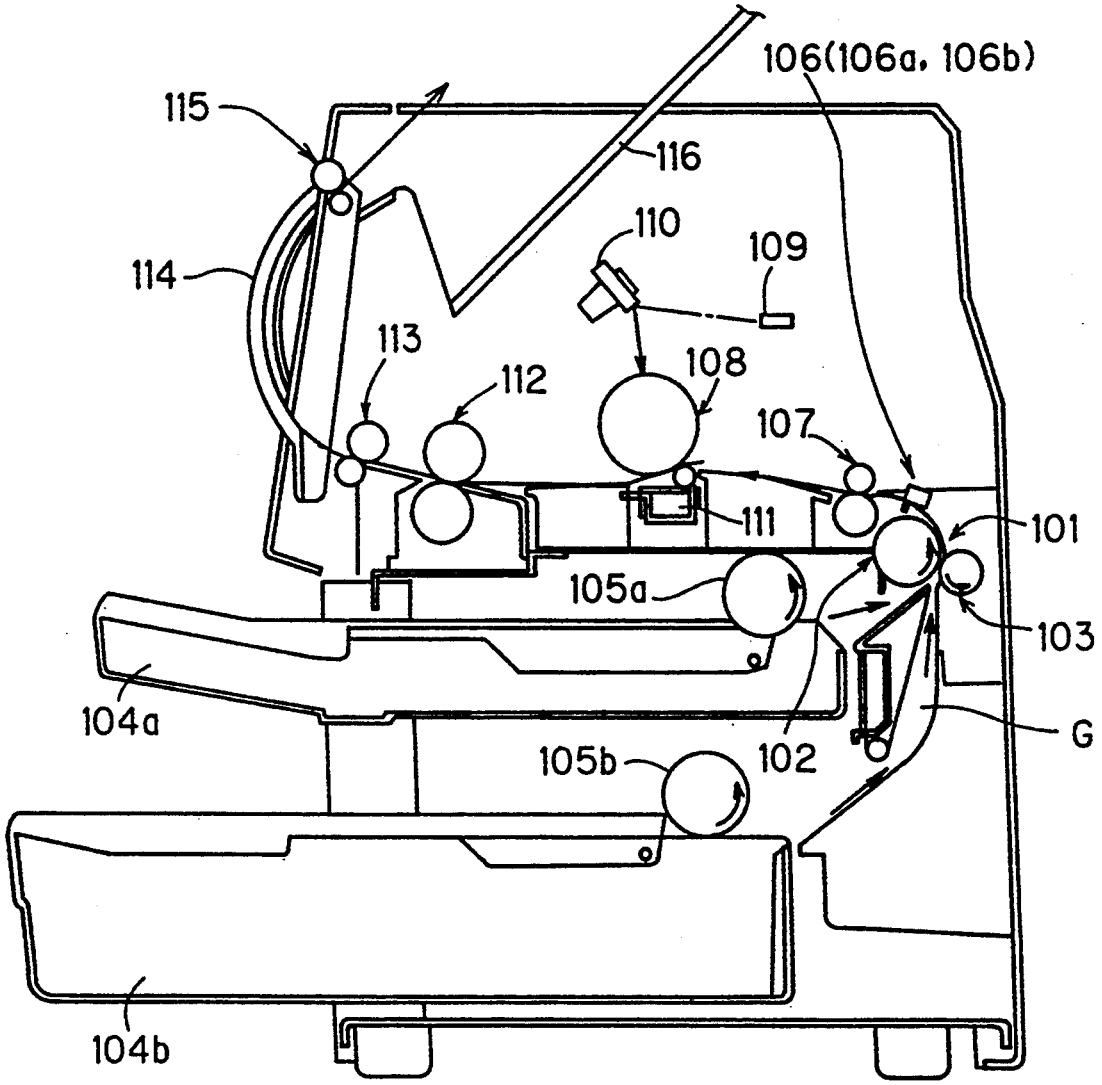
FIG. 5 is a schematic diagram illustrating the construction of an image forming apparatus comprising the pair of paper separation rollers shown in FIG. 4.

FIG. 5 illustrates the schematic construction of an image forming apparatus.

This image forming apparatus comprises paper feeding cassettes 104*a* and 104*b*, paper feeding rollers 105*a* and 105*b*. a pair of delivery rollers (a pair of paper separation rollers) 101, a registration switch 106, a pair of registration rollers 107, a photoreceptor 108, a light emitting section 109 including a laser, a polygon mirror 110, a transfer section 111, a fixing section 112 including a fixing roller, discharge rollers 113 and 115, a discharge guide 114, a discharge tray 116, and the like.

The light emitting section 109 emits light in response to an image signal inputted from, for example, the exterior of the image forming apparatus, the surface of the photoreceptor 108 is exposed through the polygon mirror 110 by the laser light from the light emitting section 109 to form an electrostatic image, and the electrostatic image is developed by a developing device (not shown).

On the other hand, paper sheets contained in the paper feeding cassette 104*a* or the paper feeding cassette 104*b* are fed by the paper feeding roller 105*a* or 105*b* and then, are fed to the pair of registration rollers 107 by the pair of paper separation rollers 101. The driving of the photoreceptor 108 and the pair of registration rollers 107 is controlled on the basis of a signal from the registration switch 106. The image developed on the surface of the photoreceptor 108 is transferred to the paper sheets fed to the photoreceptor 108 by the transfer section 111 and then, is fixed by the fixing section 112. Thereafter, the paper sheets are discharged to the discharge tray 116 through the discharge guide 114 by the discharge rollers 113 and 115.

It is assumed that paper sheets such as envelopes are contained in two right and left rows and with their being overlapped with each other for each row in the paper feeding cassette 104*a* out of the paper feeding cassettes 104*a* and 104*b*.

Figure 4:
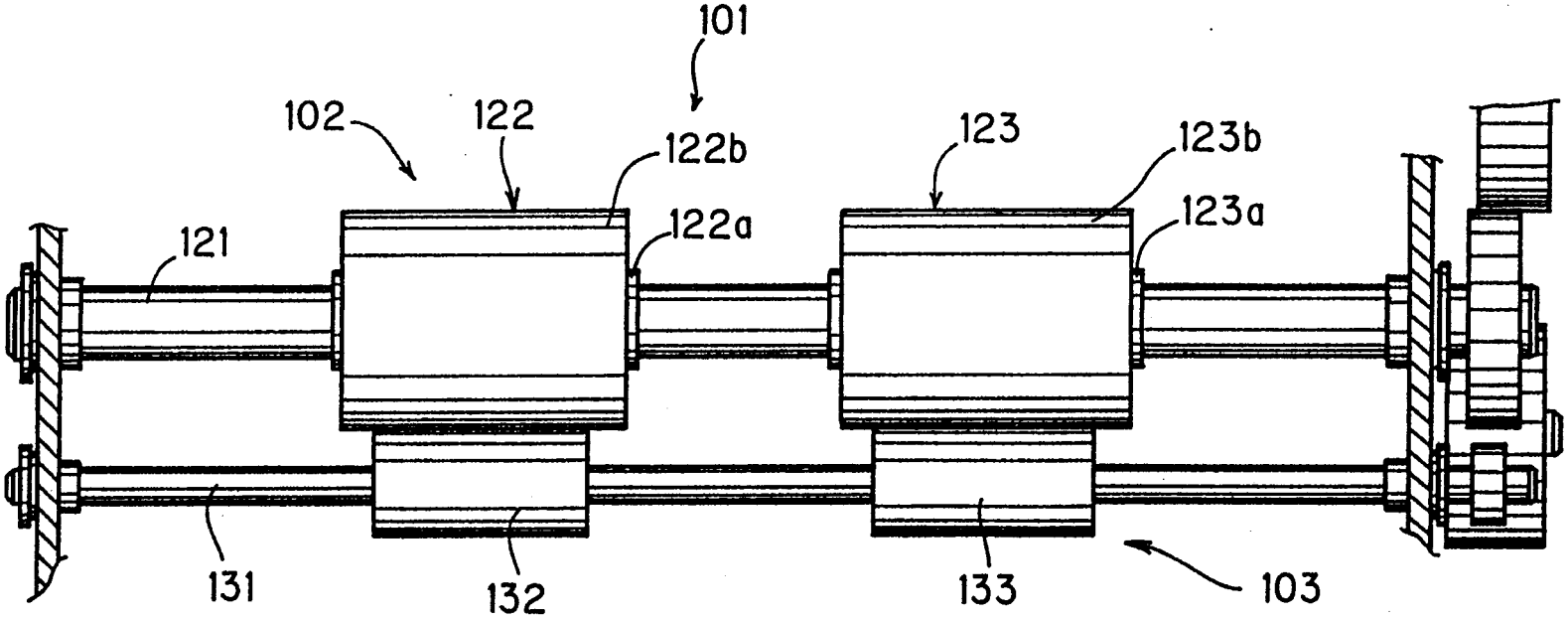
FIG. 4 is a front view illustrating a pair of paper separation rollers according to a third embodiment of the present invention.

The pair of paper separation rollers 101 comprises a forward roller 102 and a reverse roller 103. The forward roller 102 comprises a shalt 121 and two roller portions 122 and 123, as shown in FIG. 4. The forward roller 102 is rotated and driven in the direction of paper feeding (in the direction indicated by an arrow G in FIG. 5), so that two paper sheets fed in parallel from the paper feeding cassette 104*a* by the paper feeding roller 105*a* are fed in parallel to the pair of registration rollers 107. That is, the paper sheet on the left side and the paper sheet on the right side are respectively fed by the roller portion 122 and the roller portion 123.

Figure 6:
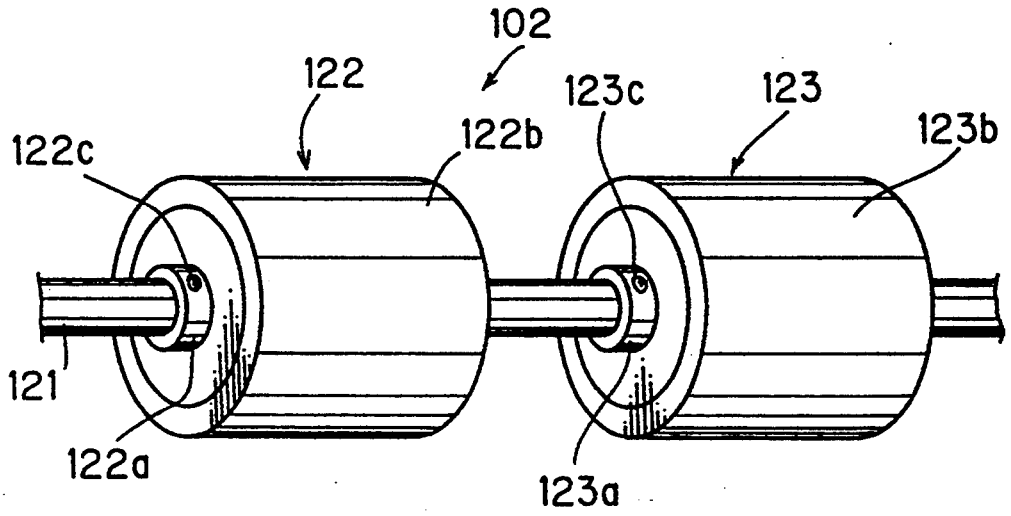
FIG. 6 is a perspective view illustrating the pair of paper separation rollers shown in FIG. 4.

Furthermore, the roller portions 122 and 123 comprise torque limiter mechanisms respectively comprising fixed portions 122*a* and 123*a* and idling portions 122*b* and 123*b*, as shown in FIG. 6. The fixed portions 122*a* and 123*a* are arranged on the inside of the idling portions 122*b* and 123*b*, and are fixed to the shaft 121 by bolts 122*c* and 123*c*, respectively. The peripheral surface parts of the idling portions 122*b* and 123*b* are made of rubber or the like, and the idling portions 122*b* and 123*b* are idled about the fixed portions 122*a* and 123*a* if load torque of not less than predetermined torque is applied thereto. That is, one of the idling portion 122*b* or 123*b* and the fixed portion 122*a* or 123*a* is made of a magnet and the other thereof is made of iron, and both are connected to each other by the magnetic force. If load torque of not less than predetermined torque is applied to the idling portions 122*b* and 123*b*. the idling portions 122*b* and 123*b* are idled.

Meanwhile, the idling portion 122*b* or 123*b* and the fixed portion 122*a* or 123*a* may be made of resin or the like and connected to each other by the friction force. In addition, the idling portion 122*b* or 123*b* and the fixed portion 122*a* or 123*a* may be connected to each other with a spring coil being interposed therebetween so that the idling portions 122*b* and 123*b* are idled if load torque of not less than the spring force of the spring coil is applied thereto.

The reverse roller 103 comprises a shaft 131, and roller portions 132 and 133 respectively opposed to the roller portions 122 and 123 in the forward roller 102, as shown in FIG. 4, and is rotated and driven in the opposite direction to the forward roller 102 so as to prevent, for example, the feeding of paper sheets one over the other.

The registration switch 106 comprises registration switches 106*a* and 106*n*. The paper sheets on the right and left sides fed in parallel are independently detected by the respective registration switches 106*a* and 106*b*. The pair of registration rollers 107 is driven when a predetermined time period has elapsed after both the registration switches 106*a* and 106*b* are turned on.

Figure 7:
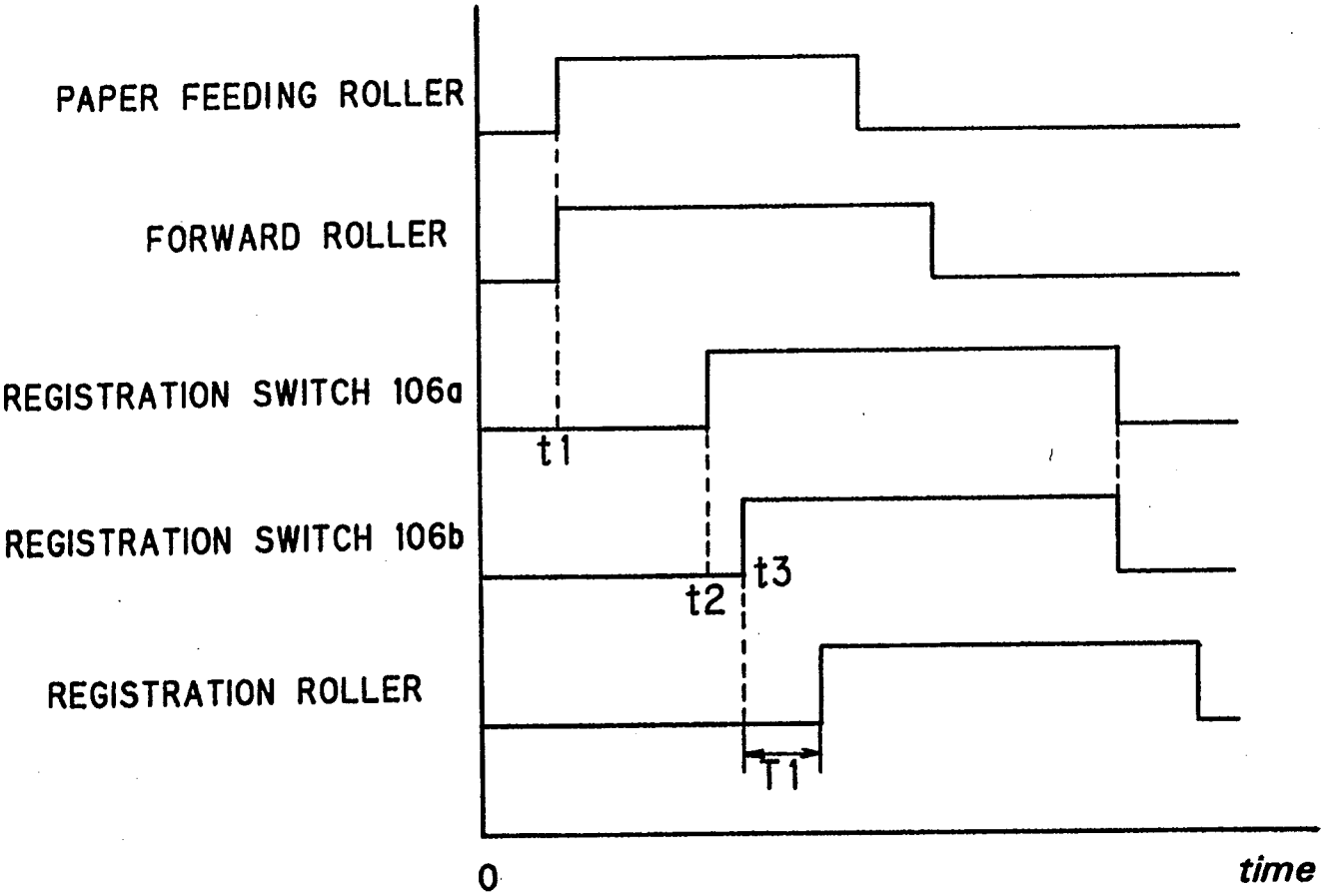
FIG. 7 is a timing chart showing the operation of the pair of paper separation rollers shown in FIG. 4.

Description is now made of the operation of the above described pair of paper separation rollers 101 with reference to a timing chart of FIG. 7.

When the paper feeding roller 105*a* is driven at the time point t1 so as to start paper feeding, two paper sheets are conveyed to the pair of paper separation rollers 101 from the paper feeding cassette 104*a*. At the same time, the pair of paper separation rollers 101 starts to be driven, so that the two paper sheets are further fed in parallel toward the pair of registration rollers 107.

When the paper sheet on the left side, for example, first reaches the registration switch 106*a* (at the time point t2), the registration switch 106*a* is turned on and then, the paper sheet on the left side abuts on the pair of registration rollers 107. At this time, the pair of paper separation rollers 101 continues to be driven so as to feed the paper sheet on the right side to the pair of registration rollers 107. Accordingly, the forward end of the above described paper sheet on the left side is pressed against the pair of registration rollers 107 by the pair of paper separation rollers 101, to be deflected. If load torque of not less than predetermined torque is applied to the forward roller 102 by the reaction of this deflection, the forward roller 102 is idled, so that the paper sheets are prevented from being deflected by not less than a predetermined amount.

On the other hand, when the paper sheet on the right side reaches the registration switch 106*b* (at the time point t3), the registration switch 106*b* is turned on. When a previously set time period T1 has elapsed after the registration switch 106*b* is turned on, that is, a time period sufficient for the paper sheet on the right side to abut on the pair of registration rollers 107 and to be slightly deflected to enter a nip state has elapsed, the pair of registration rollers 107 is driven. Consequently, the two paper sheets are fed to the photoreceptor 108.

In a case where the two paper sheets are thus fed in parallel to the pair of registration rollers 107 by the pair of paper separation rollers 101, if times when the two paper sheets abut, on the pair of registration rollers 107 deviate from each other due to, for example, the feeding of paper sheets one over the other, an attempt to cause excess deflection of the paper sheet which first abuts on the pair of registration rollers 107 is previously prevented because load torque of not less than predetermined torque is applied to the forward roller 102 by the deflection so that the forward roller 102 is idled.

Although in the foregoing description, the paper sheets are fed in parallel in two rows, the paper sheets may be fed in parallel in three or more rows. In this case, the number of roller portions in the forward roller 102 and the reverse roller 103 may be increased to coincide with the number of rows.

Referring now to FIGS. 8 to 11, description is made of a fourth embodiment of the present invention.

Figure 10:
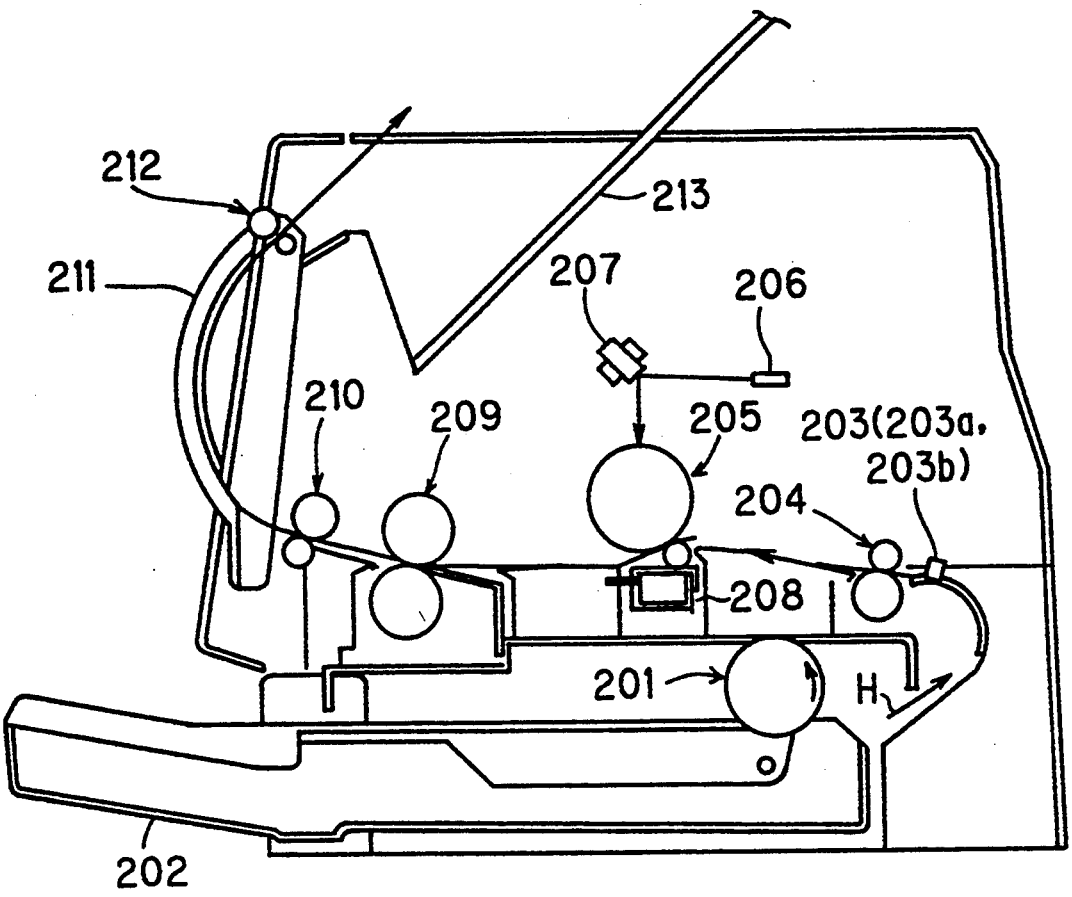
FIG. 10 is a schematic diagram illustrating the construction of an image forming apparatus comprising the paper feeding roller shown in FIG. 8.

FIG. 10 illustrates the schematic construction of an image forming apparatus.

This image forming apparatus comprises a paper feeding cassette 202, a paper feeding roller 201, a registration switch 203, a pair of registration rollers 204, a photoreceptor 205, a light emitting section 206 including a laser, a polygon mirror 207, a transfer section 208, a fixing section 209 including a fixing roller, discharge rollers 210 and 212, a discharge guide 211, a discharge tray 213, and the like.

The light emitting section 206 emits light in response to an image signal inputted from, for example, the exterior of the image forming apparatus, the surface of the photoreceptor 205 is exposed through the polygon mirror 207 by the laser light from the light emitting section 206 to form an electrostatic image, and the electrostatic image is developed by a developing device (not shown).

Figure 8:
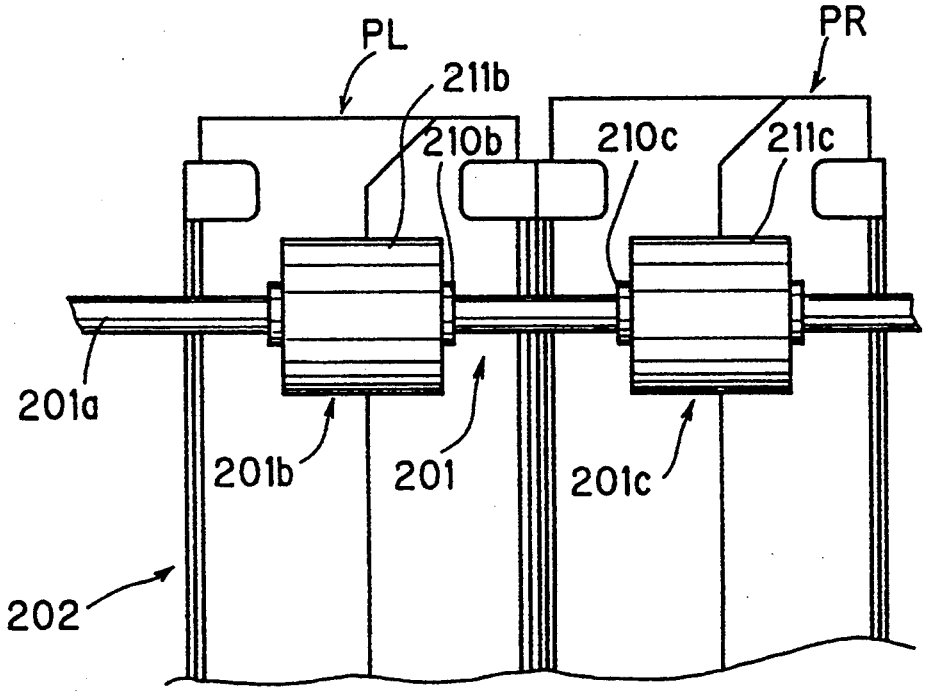
FIG. 8 is a front view illustrating a paper feeding roller according to a fourth embodiment of the present invention.

On the other hand, as shown in FIG. 8, paper sheets PL and PR are contained in two right and left rows and with they being overlapped with each other for each row in the paper feeding cassette 202. The paper sheets PL and PR in two right and left rows are fed in parallel by the paper feeding roller 201 to the pair of registration rollers 204. The driving of the photoreceptor 205 and the pair of registration rollers 204 is controlled on the basis of a signal from the registration switch 203 for detecting the paper sheets PL and PR.

The image developed on the surface of the photoreceptor 205 is transferred to the respective paper sheets PL and PR by the transfer section 208 and then, is fixed by the fixing section 209. The respective paper sheets PL and PR are discharged to the discharge tray 213 through the discharge guide 211 by the pair of discharge rollers 210 and 212.

The paper feeding roller 201 comprises a shaft 201*a* and two roller portions 201*b* and 201*c*, as shown in FIG. 8. The paper feeding roller 201 is rotated and driven in the direction of paper feeding (in the direction indicated by an arrow H in FIG. 10), so that the paper sheets PL and PR contained in two rows in the paper feeding cassette 202 are fed in parallel to the pair of registration rollers 204. That is, the paper sheets PL on the left side and the paper sheets PR on the right side are respectively fed by the roller portion 201*b* and the roller portion 201*c*.

Figure 9:
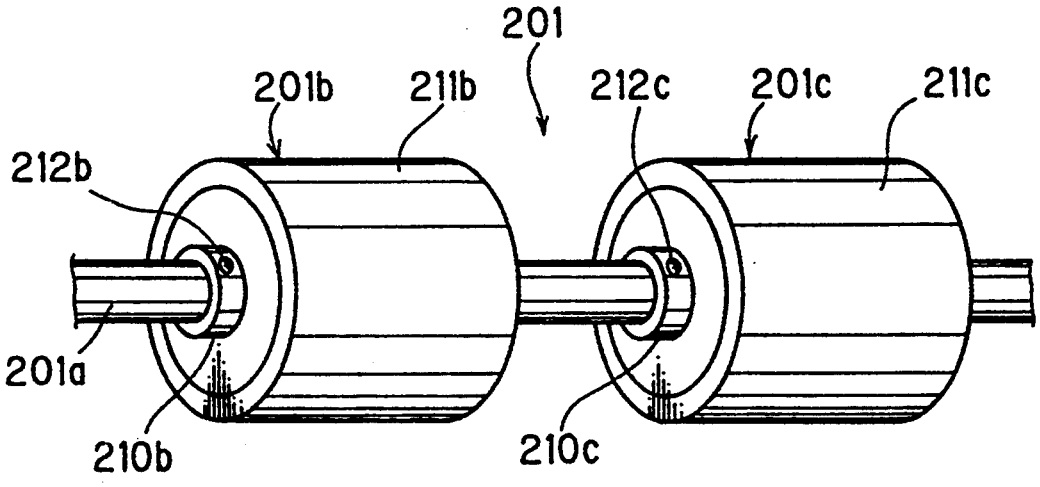
FIG. 9 is a perspective view illustrating the paper feeding roller shown in FIG. 8.

Furthermore, the roller portions 201*b* and 201*c* comprise torque limiter mechanisms respectively comprising fixed portions 210*b* and 210*c* and idling portions 211*b* and 211*c*, as shown in FIGS. 8 and 9. The fixed portions 210*b* and 210*c* are arranged on the inside of the idling portions 211*b* and 211*c*, and are fixed to the shaft 201*a* by bolts 212*b* and 212*c*, respectively. The peripheral surface parts of the idling portions 211*b* and 211*c* are made of rubber or the like, and the idling portions 211*b* and 211*c* are idled about the fixed portions 210*b* and 210*c* if load torque of not less than predetermined torque is applied thereto. That is, one of the idling portion 211*b* or 211*c* and the fixed portion 210*b* or 210*c* is made of a magnet and the other thereof is made of iron, and both are connected to each other by the magnetic force. If load torque of not less than predetermined torque is applied to the idling portions 211*b* and 211*c*, the idling portions 211*b* and 211*c* are idled.

Meanwhile, the idling portion 211*b* or 211*c* and the fixed portion 210*b* or 210*c* may be made of resin or the like and connected to each other by the friction force. In addition, the idling portion 211*b* or 211*c* and the fixed portion 210*b* or 210*c* may be connected to each other with a spring coil being interposed therebetween so that the idling portions 211*b* and 211*c* are idled if load torque of not less than the spring force of the spring coil is applied thereto.

The registration switch 203 comprises registration switches 203*a* and 203*b*. The paper sheets on the right and left sides fed in parallel are independently detected by the respective registration switches 203*a* and 203*b*. The pair of registration rollers 204 is driven when a predetermined time period has elapsed after both the registration switches 203*a* and 203*b* are turned on.

Figure 11:
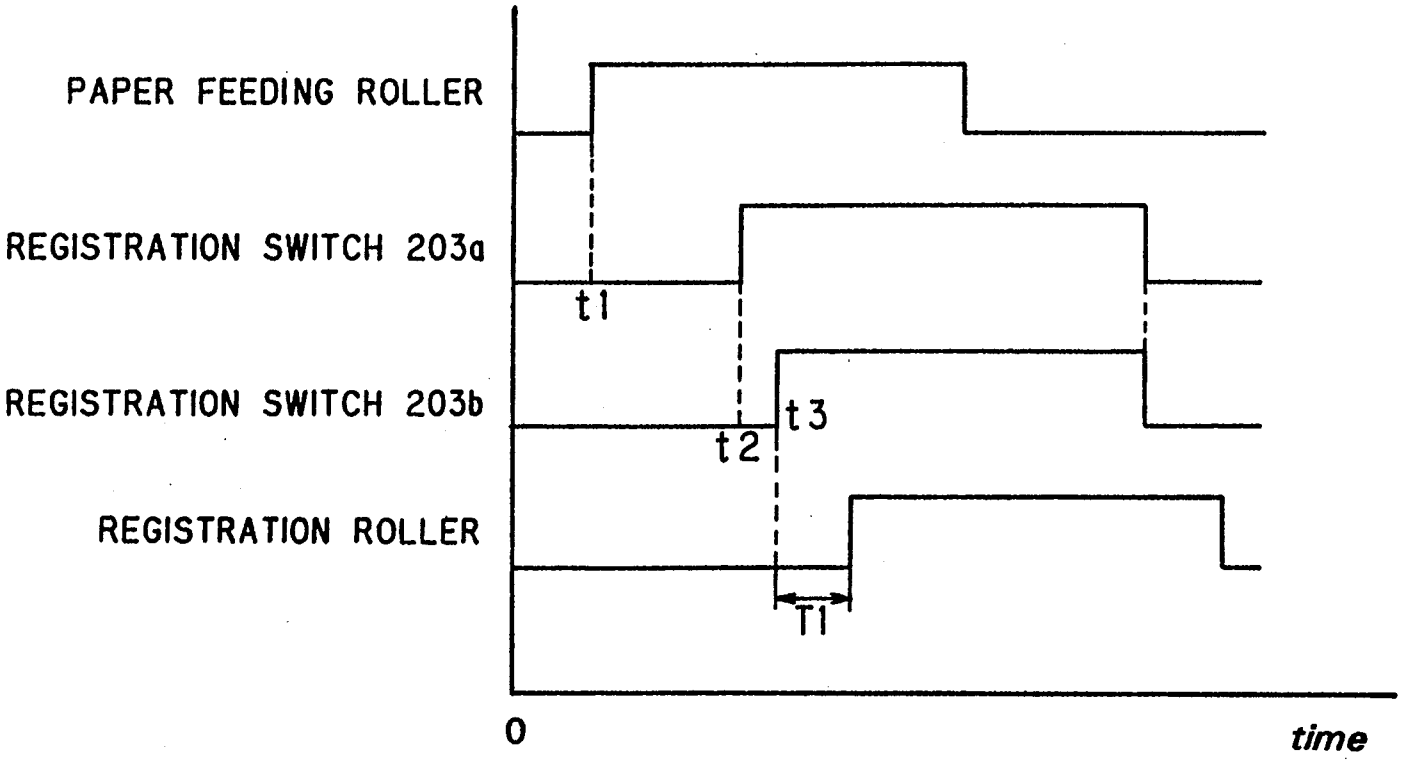
FIG. 11 is a timing chart showing the operation of the paper feeding roller shown in FIG. 8.

Description is now made of the operation of the above described paper feeding roller 201 with reference to a timing chart of FIG. 11.

When the paper feeding roller 201 is driven at the time point t1, the roller portions 201*b* and 201*c* in the paper feeding roller 201 start to be rotated so as to start paper feeding so that the paper sheets PL and PR in the paper feeding cassette 202 are fed in parallel toward the pair of registration rollers 204.

Figure 12:
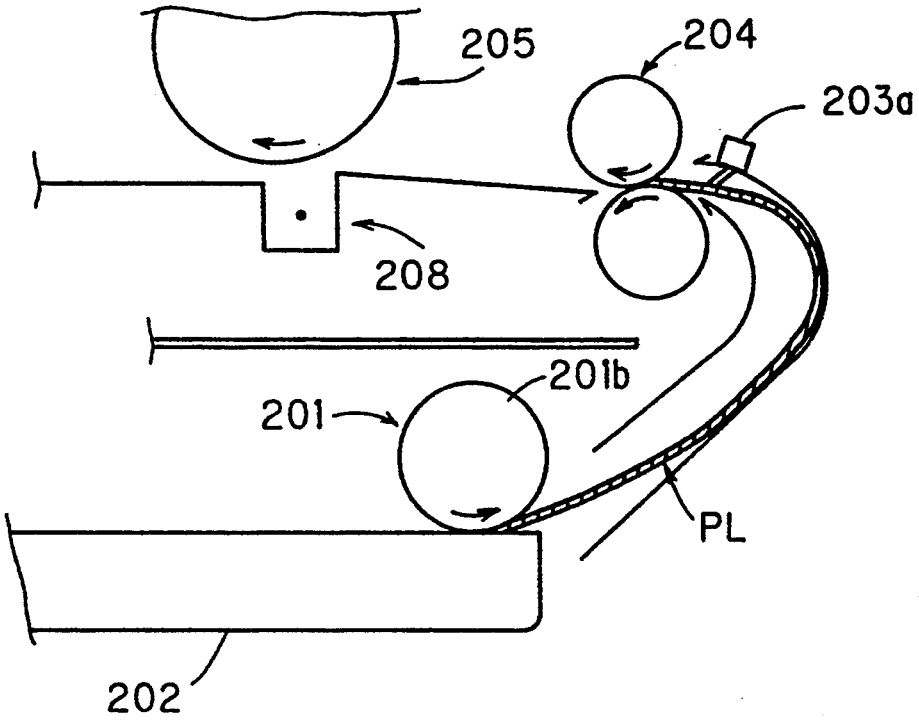
FIG. 12 is a diagram illustrating a state where a paper sheet which first reaches a registration roller is deflected.

When the paper sheet PL on the left side first reaches the registration switch 203 due to, for example, the feeding of paper sheets one over the other (at the time point t2), the registration switch 203*a* is turned on and then, the paper sheet PL on the left side abuts on the pair of registration rollers 204. At this time, the paper feeding roller 201 continues to be driven so as to feed the paper sheet PR on the right side to the pair of registration rollers 204. Accordingly, as shown in FIG. 12, the forward end of the paper sheet PL on the left side is pressed against the pair of registration rollers 204 by the paper feeding roller 201, to be deflected. If load torque of not less than predetermined torque is applied to the roller portion 201*b* by the reaction of this deflection, the roller portion 201*b* is idled, so that the paper sheet PL is prevented from being deflected by not less than a predetermined amount.

On the other hand, when the paper sheet PR on the right side reaches the registration switch 203*b* (at the time point t3), the registration switch 203*b* is turned on. When a previously set time period T1 has elapsed after the above described registration switch 203*b* is turned on, that is, a time period sufficient for the paper sheet PR on the right side to abut on the pair of registration rollers 204 and to be slightly deflected to enter a nip state has elapsed, the pair of registration rollers 204 is driven. Consequently, both the paper sheets PL and PR are fed to the photoreceptor 205.

In a case where the paper sheets PL and PR in the paper feeding cassette 202 are thus fed in parallel to the pair of registration rollers 204, if times when the two paper sheets PL and PR abut on the pair of registration rollers 204 deviate from each other due to, for example, the feeding of paper sheets one over the other, an attempt to cause excess deflection of the paper sheet which first abuts on the pair of registration rollers 204 is previously prevented because load torque of not less than predetermined torque is applied to the corresponding roller portions 201*b* and 210*c* by the deflection so that the roller portions are idled.

Although in the foregoing description, the paper sheets are fed in parallel in two rows, the paper sheets may be fed in parallel in three or more rows. In this case, the number of roller portions may be increased to coincide with the number of rows.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In a paper feeding device comprising a paper feeding roller means for feeding at least two sheets in parallel from a paper feeding cassette to registration rollers, wherein:

said paper feeding roller means has a rotatable and driveable axis of rotation and a plurality of feeding roller portions provided side by side on said axis of rotation for respectively feeding the paper sheets side by side, to said registration rollers, and each of said feeding roller portions includes a torque limiter mechanism which idles if a load of not less than a predetermined torque is applied thereto when the leading edge of a paper sheet in a row corresponding to one of said feeding roller portions abuts respective portions of said registration rollers and the sheet is deflected by said registration roller portions.

2. The paper feeding device as claimed in claim 1, wherein:

said feeding device further comprises switch means which are activated by conveyance of a sheet, said registration rollers being activated a predetermined time after activation of said switch means.

3. The paper feeding device as claimed in claim 1, wherein:

said feeding roller has rubber outer surface.

4. The paper feeding device as claimed in claim 1, wherein:

said torque limiter mechanism has a fixed portion including a magnet and a roller portion comprising iron.

5. The paper feeding device as claimed in claim 1, wherein:

said torque limiter mechanism has a friction mechanism.

6. The paper feeding device as claimed in claim 1, wherein:

said torque limiter mechanism includes a spring coil connected between said axis and said roller portion.

* * * * *